US008926418B2

(12) United States Patent
Anderson et al.

(10) Patent No.: US 8,926,418 B2
(45) **Date of Patent: *Jan. 6, 2015**

(54) CONFIGURING AND CONTROLLING WAGERING GAME COMPATIBILITY

(71) Applicant: WMS Gaming, Inc., Waukegan, IL (US)

(72) Inventors: Peter R. Anderson, Glenview, IL (US); Michael J. Irby, II, Chicago, IL (US); Craig J. Sylla, Round Lake, IL (US)

(73) Assignee: WMS Gaming, Inc., Waukegan, IL (US)

( * ) Notice: Subject to any disclaimer, the term of this patent is extended or adjusted under 35 U.S.C. 154(b) by 56 days.

This patent is subject to a terminal disclaimer.

(21) Appl. No.: 13/744,892

(22) Filed: Jan. 18, 2013

(65) Prior Publication Data

US 2013/0130808 A1 May 23, 2013

Related U.S. Application Data

(63) Continuation of application No. 13/146,368, filed as application No. PCT/US2010/022295 on Jan. 27, 2010, now Pat. No. 8,357,039.

(60) Provisional application No. 61/148,141, filed on Jan. 29, 2009.

(51) Int. Cl.
*G07F 17/32* (2006.01)

(52) U.S. Cl.
USPC ..... 463/16; 463/20; 463/25; 463/29; 463/42

(58) Field of Classification Search
USPC ..... 463/16–20, 25–29
See application file for complete search history.

(56) References Cited

U.S. PATENT DOCUMENTS

| | | | |
|---|---|---|---|
| 5,655,961 | A | 8/1997 | Acres et al. |
| RE37,885 | E | 10/2002 | Acres et al. |
| RE38,812 | E | 10/2005 | Acres et al. |
| 7,144,321 | B2 | 12/2006 | Mayeroff |
| 7,285,049 | B1 | 10/2007 | Luciano, Jr. |
| 2002/0052235 | A1 | 5/2002 | Hirsch et al. |

(Continued)

FOREIGN PATENT DOCUMENTS

| | | |
|---|---|---|
| GB | 2480784 | 11/2011 |
| WO | WO-2006076185 | 7/2006 |

(Continued)

OTHER PUBLICATIONS

"AU Application No. 2010208332 Examiners Report", Apr. 12, 2013 , 2 pages.

(Continued)

*Primary Examiner* — Omkar Deodhar
(74) *Attorney, Agent, or Firm* — DeLizio Gilliam, PLLC

(57) ABSTRACT

A wagering game system and its operations are described herein. In some embodiments, the operations can include determining that a secondary wagering game application is compatible with a primary wagering game application, wherein compatibility is based in-part on an ability of the primary wagering game application to provide wagering game information to the secondary wagering game application via an application programming interface. The operations can also include enabling the secondary wagering game to present a secondary wagering game in connection with a primary wagering game controlled by the primary wagering game application.

18 Claims, 9 Drawing Sheets

(56) References Cited

U.S. PATENT DOCUMENTS

| | | | | |
|---|---|---|---|---|
| 2004/0254014 | A1* | 12/2004 | Quraishi et al. | 463/29 |
| 2006/0073887 | A1 | 4/2006 | Nguyen et al. | |
| 2006/0073888 | A1 | 4/2006 | Nguyen et al. | |
| 2006/0142079 | A1 | 6/2006 | Ikehara et al. | |
| 2007/0060314 | A1 | 3/2007 | Baerlocher et al. | |
| 2007/0060321 | A1 | 3/2007 | Vasquez et al. | |
| 2007/0191088 | A1 | 8/2007 | Breckner et al. | |
| 2007/0218975 | A1 | 9/2007 | Iddings et al. | |
| 2007/0259709 | A1 | 11/2007 | Kelly et al. | |
| 2007/0293293 | A1 | 12/2007 | Baerlocher et al. | |
| 2007/0298857 | A1 | 12/2007 | Schlottmann et al. | |
| 2007/0298874 | A1 | 12/2007 | Baerlocher et al. | |
| 2007/0298875 | A1 | 12/2007 | Baerlocher et al. | |
| 2008/0020830 | A1 | 1/2008 | Ikehara et al. | |
| 2008/0020831 | A1 | 1/2008 | Ikehara et al. | |
| 2008/0020832 | A1 | 1/2008 | Iddings et al. | |
| 2008/0020833 | A1 | 1/2008 | Baerlocher et al. | |
| 2008/0020834 | A1 | 1/2008 | Breckner et al. | |
| 2008/0020846 | A1 | 1/2008 | Vasquez et al. | |
| 2008/0045344 | A1 | 2/2008 | Schlottmann et al. | |
| 2008/0064502 | A1 | 3/2008 | Schlottmann et al. | |
| 2008/0070680 | A1 | 3/2008 | Baerlocher et al. | |
| 2008/0070692 | A1 | 3/2008 | Schlottmann et al. | |
| 2008/0070693 | A1 | 3/2008 | Schlottmann et al. | |
| 2008/0070694 | A1 | 3/2008 | Schlottmann et al. | |
| 2008/0070695 | A1 | 3/2008 | Baerlocher et al. | |
| 2008/0076514 | A1 | 3/2008 | Baerlocher et al. | |
| 2008/0076515 | A1 | 3/2008 | Baerlocher et al. | |
| 2008/0076517 | A1 | 3/2008 | Baerlocher et al. | |
| 2008/0076552 | A1 | 3/2008 | Baerlocher et al. | |
| 2008/0108423 | A1 | 5/2008 | Benbrahim et al. | |
| 2008/0113813 | A1* | 5/2008 | Wright et al. | 463/42 |
| 2008/0300049 | A1 | 12/2008 | Anderson et al. | |
| 2011/0287828 | A1 | 11/2011 | Anderson et al. | |

FOREIGN PATENT DOCUMENTS

| | | |
|---|---|---|
| WO | WO-2007006002 | 1/2007 |
| WO | WO-2007139874 | 12/2007 |
| WO | WO-2007139988 | 12/2007 |
| WO | WO-2008030904 | 3/2008 |
| WO | WO-2008033392 | 3/2008 |
| WO | WO-2008039403 | 4/2008 |
| WO | WO-2008060426 | 5/2008 |
| WO | WO-2008060442 | 5/2008 |
| WO | WO-2008060459 | 5/2008 |
| WO | WO-2008060513 | 5/2008 |
| WO | WO-2008106404 | 9/2008 |

OTHER PUBLICATIONS

"PCT Application No. PCT/US10/22295 International Preliminary Report on Patentability", Apr. 13, 2011 , 13 pages.

"PCT Application No. PCT/US10/22295 International Search Report", Mar. 31, 2010 , 9 pages.

* cited by examiner

CONFIGURING AND CONTROLLING WAGERING GAME COMPATIBILITY

RELATED APPLICATIONS

This application claims priority to, and is a continuation application of, U.S. application Ser. No. 13/146,368, filed on Jul. 26, 2011. The application Ser. No. 13/146,368 is a continuation application and claims priority benefit of PCT Application No. PCT/US10/22295, filed on Jan. 27, 2010, which claims the priority benefit of U.S. Provisional Application No. 61/148,141 filed Jan. 29, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

TECHNICAL FIELD

Embodiments of the inventive subject matter relate generally to wagering game systems and networks that, more particularly, configure and control wagering game compatibility.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. However, sometimes, the development of new games can become complex and present challenges for developers and game operators alike. Therefore, there is a continuing need for wagering game machine manufacturers to continuously develop new games and gaming enhancements that will attract frequent play, but that are also easy to use, control, and configure.

BRIEF DESCRIPTION OF THE DRAWING(S)

Embodiments are illustrated in the Figures of the accompanying drawings in which.

DESCRIPTION OF ILLUSTRATIVE EMBODIMENTS

Figure 1:
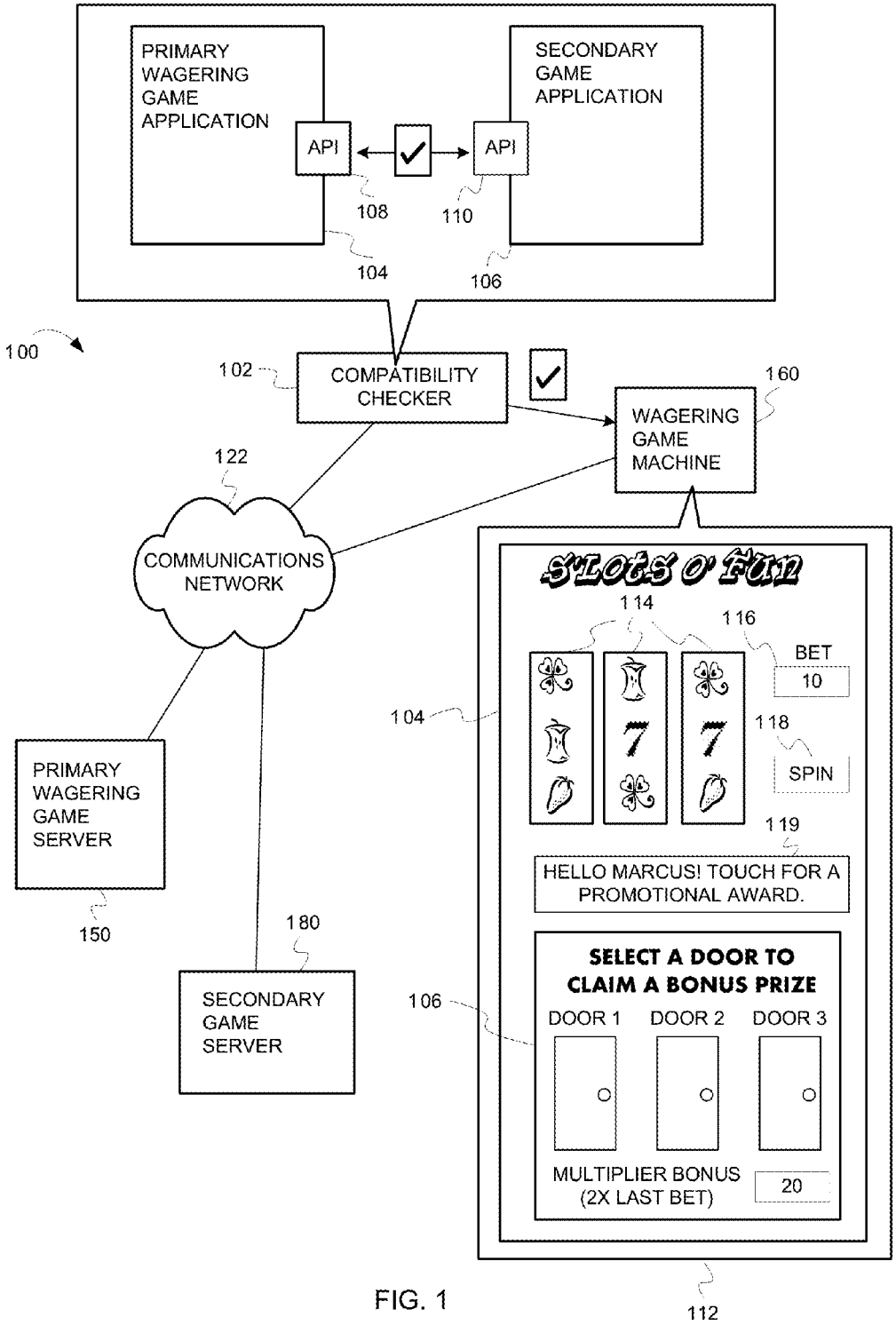
FIG. 1 is an illustration of determine compatibility between primary wagering games and secondary games, according to some embodiments.

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

As mentioned previously, there is a continuing need for wagering game machine manufacturers to continuously develop new games and gaming enhancements that will attract frequent play, but that are easy to use, control, and configure. Some gaming enhancements have included providing secondary (e.g., bonus) games that are associated with primary wagering games (e.g., base games). Wagering game developers, however, have faced challenges developing secondary games in conjunction with primary wagering games as the secondary game content (e.g., assets, code, etc.) is programmed in conjunction with (e.g., combined with, compiled into, etc.) the primary wagering game's content, thus extending the development cycle of the primary wagering game. Further, when the programming for a secondary game is modified, the potential for affecting the primary wagering game increases, and vice versa, because the game code, assets, content, etc. for the primary wagering game are tied to the secondary game's code, assets, content, etc.

Some embodiments describe examples of presenting one or more secondary applications (e.g. secondary games, secondary wagering games, bonuses, etc.), in conjunction with a primary wagering game in a wagering game session. However, the primary wagering game and the one or more secondary applications are separate, such that their content, code, assets, etc. are not programmed together, and run as separate applications. Nevertheless, in some embodiments, the needs of the secondary application may need to integrate with functionality, information, or other features available from, or through, the primary wagering game. For instance, the primary wagering game may have wagering functionality and other game control features. The one or more secondary applications may need to utilize the wagering functionality or other game control features of the primary wagering game to conduct wagers within the secondary game (e.g., in a secondary wagering game associated with the primary wagering game). Further, in other examples, the primary wagering game may have access to financial data or account information that the secondary application needs to access also. Some embodiments, therefore, can provide the wagering functionality, financial data, account information, or other features and information of the primary wagering game, to the secondary application, via application programming interfaces (APIs) available for the primary wagering game application and the secondary application. During the course of configuration, play, or at other times, some embodiments can also determine whether primary wagering games and secondary applications are compatible. For example, some embodiments can determine requirements of the secondary application to access or use the primary wagering game's functionality and/or data and determine whether the primary wagering game's API can provide the necessary functionality and/or data so that the secondary application can function without operational errors, significant delays, missing data, or other problems.

In some embodiments, a secondary application may be referred to more specifically as a "secondary game" as an example of a possible secondary application that is triggered, requested, supported, etc., by a primary wagering game, and which may require interaction with the primary wagering game. However, it should be noted that the secondary application does not need to be limited to game applications, but could also be related to other secondary applications (e.g., promotional applications, social networking applications, player tracking applications, etc.) that may require interaction with the primary wagering game. Also, in some embodiments herein a player may be referred to interchangeably as a player account, or vice versa. Account-based wagering systems often utilize player accounts when transacting and performing activities, at the computer level, that are initiated by players. Therefore, a "player account" is often referred to herein as a representative of the player at a computerized level. Therefore, for brevity, to avoid having to describe the interconnection between player and player account in every instance, a "player account" may be referred to herein in either context. Further, in some embodiments herein, the word "gaming" may be used interchangeably with the word "gambling". Further, the words "wagering game" are used to indicate electronic (e.g., electromechanical, digital, computerized, etc.) games (e.g., slot games, electronic poker, electronic bingo, etc.) that use (e.g., process a form of, are based on, are funded by, etc.) a monetary bet or wager.

FIG. 1 is a conceptual diagram that illustrates an example of determining compatibility between primary wagering games and secondary games, according to some embodiments. In FIG. 1, a wagering game system ("system") 100 includes a primary wagering game server 150 and a secondary game server 180 connected to a wagering game machine 160 via a communications network 122. The wagering game machine 160 has access to (e.g., contains, is connected to, etc.) a compatibility checker 102. The primary wagering game server 150 provides primary wagering game content. Primary wagering game content can include wagering games that receive bets, produce chance results, and award winning results with money pay outs. Examples of primary wagering game content include primary game play elements that present game play, such as slot reels, poker cards, etc. The primary wagering game content permits the wagering game player to place a primary wager that enables game play on the wagering game machine 160. A secondary game may include bonus games or features that plug into, are initiated by, are funded by, or are in some other way connected to the primary wagering game. The wagering game machine 160 includes a display 112 where a secondary game 106 is presented in connection with (e.g., in concert with, resulting from, etc.) a primary wagering game 104. In the some embodiments, the secondary game 106 can process secondary wagers, or wagers that are placed during the secondary game. The wagering game machine 160 can present secondary game play elements (e.g., game graphics and control elements that present game play during the secondary game). The wagering game machine 160 can produce, or receive, secondary wagering game results and present the results using the secondary game play elements. The secondary game can also provide monetary awards based on winning game results. Consequently, in some embodiments, the secondary game may be referred to herein as a "secondary wagering game". In some embodiments, however, the secondary game may provide game play that does not receive wagers or bets. The secondary game can also provide awards that are not money pay outs (e.g., points, merchandise, discounts, status rewards, perks, etc.). In some embodiments, the secondary game 106 can provide money payouts (e.g., credits) as a result of game play during the secondary game 106 even though the secondary game 106 may not require wagers or bets. As stated previously, in some embodiments, the secondary game 106 can be an application that is separate from an application for the primary wagering game. Thus, the primary wagering game 104 may be referred to herein as a "primary wagering game application" or "primary game application". The secondary game 106 may be referred to herein as a "secondary game application". The secondary game application can include code that is packaged, compiled, and/or stored separately from code for the primary wagering game application. The primary wagering game 104 and secondary game 106 can run separately (e.g., can run under separate processes, can have separate memory allocations, etc.), even though they are run at the same time. During run time they can run in conjunction with each other (e.g., in connection with each other, pass data between each other, present or control common content or data, utilize each other's functionality, utilize each other's programming functions, methods, or protocols, access each other's data, are dynamically linked, etc.). One way that the separate applications, or programs, can run in conjunction with each other is via one or more well-defined APIs. Developers can develop the applications for the primary wagering game 104 and secondary game 106 separately, having separate program assets, content, code, etc. Thus, the separate applications do not have to be combined during creation and approval. The secondary game code does not have to be compiled into the primary wagering game code, thus allowing the applications to have independent development times, independent internal development approval processes, independent external approval processes (e.g., jurisdictional gaming approvals), etc. Another advantage of the runtime linking of the primary and secondary game is that the number of combinations of games is increased exponentially therefore resulting in a greater variety of play experiences for the operator and player. Further, the primary wagering game 104 can have separate pay tables from the secondary game 106 (e.g., for profit calculation and jurisdictional requirements). Also, the primary wagering game 104 and secondary game 106 can run using distinct technologies (e.g., secondary games can be thin client or server based applications while primary wagering games can be thick client applications). In some embodiments, the system 100 can track types, or classifications, of games (e.g., types of secondary games), and store the types such that the compatibility checker can determine whether the primary wagering game 104 can work in conjunction with the secondary game 106. More specifically, the system 100 can determine whether the API 108 for the primary wagering game 104 is compatible with (e.g., works in conjunction with) the API 110 for the secondary game 106. By keeping track of types, the system 100 can easily determine whether the primary wagering game 104 is compatible with other secondary games of the same type. The system 100 can quickly determine whether a secondary game and a primary wagering game will work together to present common data or content, to control common functionality, etc. The system 100 can approve and activate the other secondary games of the same type with the same primary wagering game 104 whenever the other secondary games are requested by the wagering game machine 160 or other wagering game devices.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
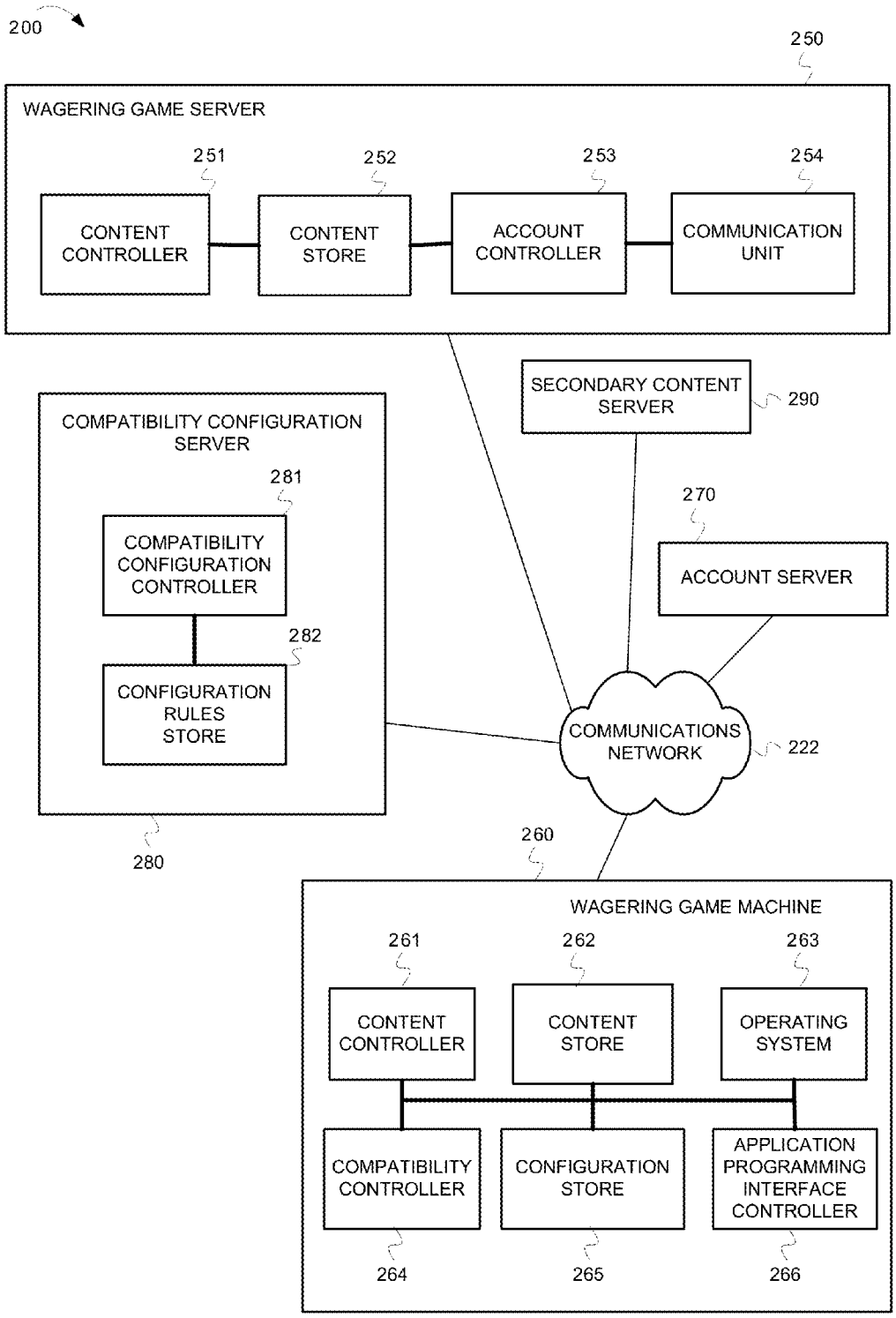
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store, track, and control player information, such as identifying information (e.g., avatars, screen name, account identification numbers, etc.) or other information like financial account information, social contact information, etc. The account server 270 can contain accounts for social contacts referenced by the player account. The account server 270 can provide auditing capabilities, according to regulatory rules, and track the performance of players, machines, and servers.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260 (e.g., primary wagering games). The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices, and networks.

The wagering game system architecture 200 can also include the wagering game machine 260 configured to present wagering games and receive and transmit information to configure and control wagering game compatibility. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include an operating system 263 configured to control the operation and presentation of system objects and instructions. The wagering game machine 260 can also include a compatibility controller 264 configured to control the compatibility of primary wagering games and secondary applications (e.g., secondary games) including determining whether a primary wagering game and an independent secondary game can interface with each other's functionality, information, etc. (e.g., via each other's application programming interfaces). The wagering game machine 260 can also include a configuration store 265 configured to store configurations made regarding compatibilities between primary wagering games and secondary applications including storing configuration files with compatibility lists, secondary game type lists, etc. The wagering game machine 260 can also include an application programming interface controller 266 configured to control communications and interface capabilities between primary wagering games and secondary applications.

The wagering game system architecture 200 can also include a secondary content server 290 configured to provide content and control information for secondary games and other secondary content available on a wagering game network (e.g., secondary wagering game content, promotions content, advertising content, player tracking content, web content, etc.). For example, in FIG. 1, the secondary game server 180 may be a type of secondary content server that provides secondary games utilized in conjunction with primary wagering games. In some embodiments, however, other secondary applications can function in conjunction with primary wagering games, such as player tracking applications, promotional or advertising applications, etc.

The wagering game system architecture 200 can also include a compatibility configuration server 280 configured to process and control information to configure and control application interfacing between primary wagering game applications and secondary applications. The compatibility configuration server 280 can include a compatibility configuration controller 281 configured to control the configuration of compatibilities between primary wagering games and secondary games. The compatibility configuration controller 281 can determine features, functionality, requirements, etc. from secondary games and provide types, or categories, for those games. The compatibility configuration controller 281 can also determine functionality, capabilities, etc. of a primary wagering game. The compatibility configuration controller 281 can compare the features, functionality, requirements, etc. from the secondary game with the functionality, capabilities, etc. of the primary wagering game and determine whether they are compatible. For example, the compatibility configuration controller 281 can determine whether the primary wagering game's API can provide the functionality and capabilities that are required by the secondary game to access information from, use functionality from, or in other ways interact with, the primary wagering game. The compatibility configuration controller 281 can also determine whether the secondary game's API can communicate data and interface with the primary game's API. Further, the compatibility configuration controller 281 can determine whether primary wagering games and secondary games are partially compatible with each other and provide types for secondary games that indicate partial compatibility (e.g., so that a secondary game may function in a partial compatibility mode, having all necessary requirements met by the primary wagering game's API, though not necessarily all optional requirements). The compatibility configuration controller 281 can also store scripts, or other mechanisms, that can add functionality to primary wagering games that may be lacking from the primary wagering game or from the API capabilities, so that the secondary game can function in full or partial compatibility modes at game run-time. In some embodiments, the system can also add functionality to secondary games or their APIs. The compatibility configuration server 280 can store the scripts and mechanisms, along with type lists and compatibility lists, with devices on the wagering game network, such as on the primary wagering game server 250, the secondary content server 290, and the wagering game machine 260. The compatibility configuration server 280 can also include a configuration rules store 282 configured to store rules concerning compatibilities of program functionality and access capabilities, store rules concerning assigning types to secondary games, store rules concerning adding functionality to primary wagering games and/or to primary wagering game APIs, etc.

Each component shown in the wagering game system architecture 200 is shown as a separate and distinct element connected via a communications network 222. However, some functions performed by one component could be performed by other components. For example, the wagering game server 250 can also be configured to perform functions of the compatibility controller 264, the configuration store 265, the application programming interface controller 266, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250. The wagering game machine 260, or other wagering game machines described herein can take any suitable form, such as floor standing models, handheld mobile units, bar-top models, workstation-type console models, surface computing machines, etc. Further, the wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as a thin, thick, or intermediate client. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
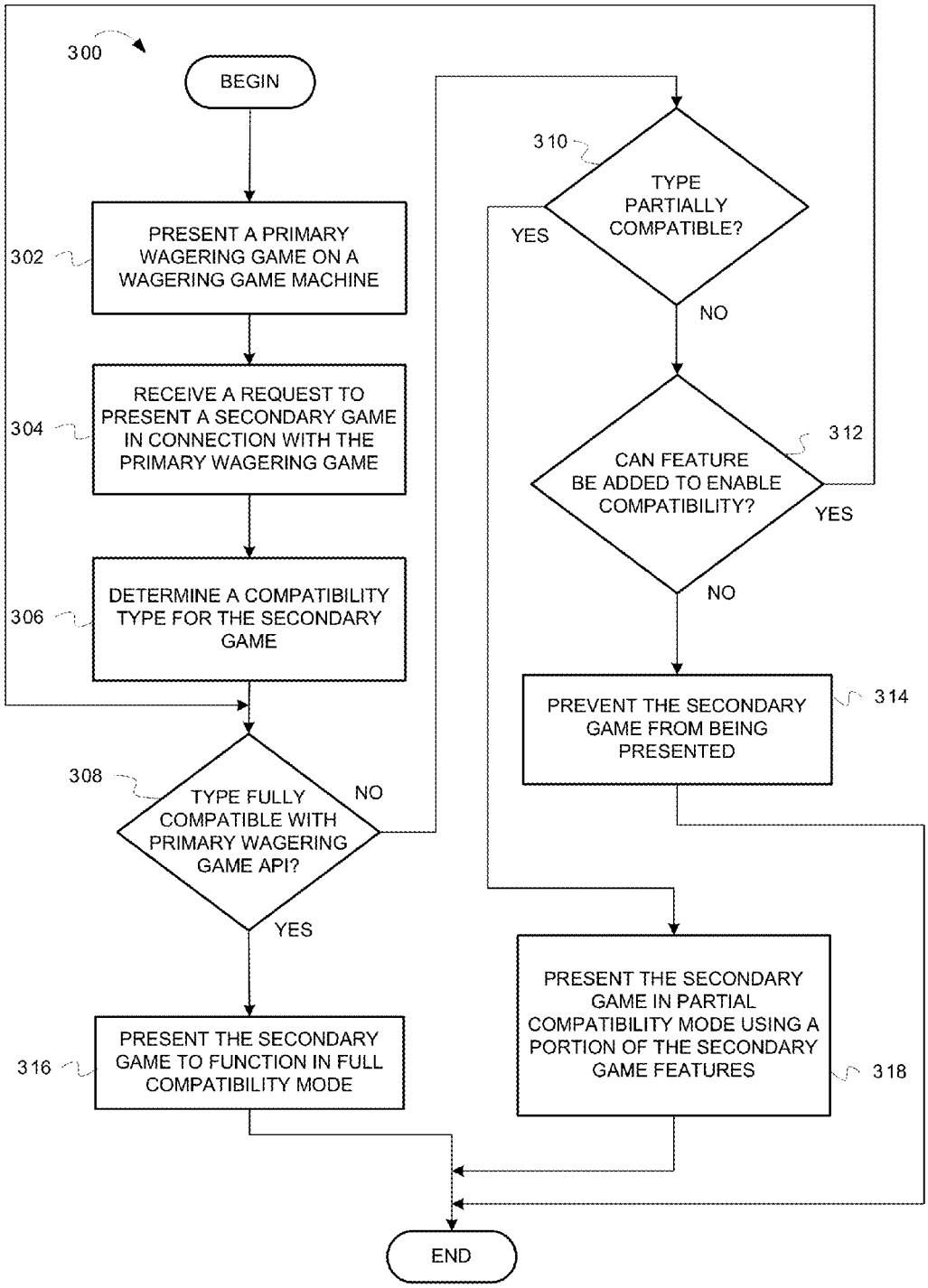
FIG. 3 is a flow diagram 300 illustrating determining compatibility between primary wagering games and secondary games using type configurations, according to some embodiments.
Figure 4:
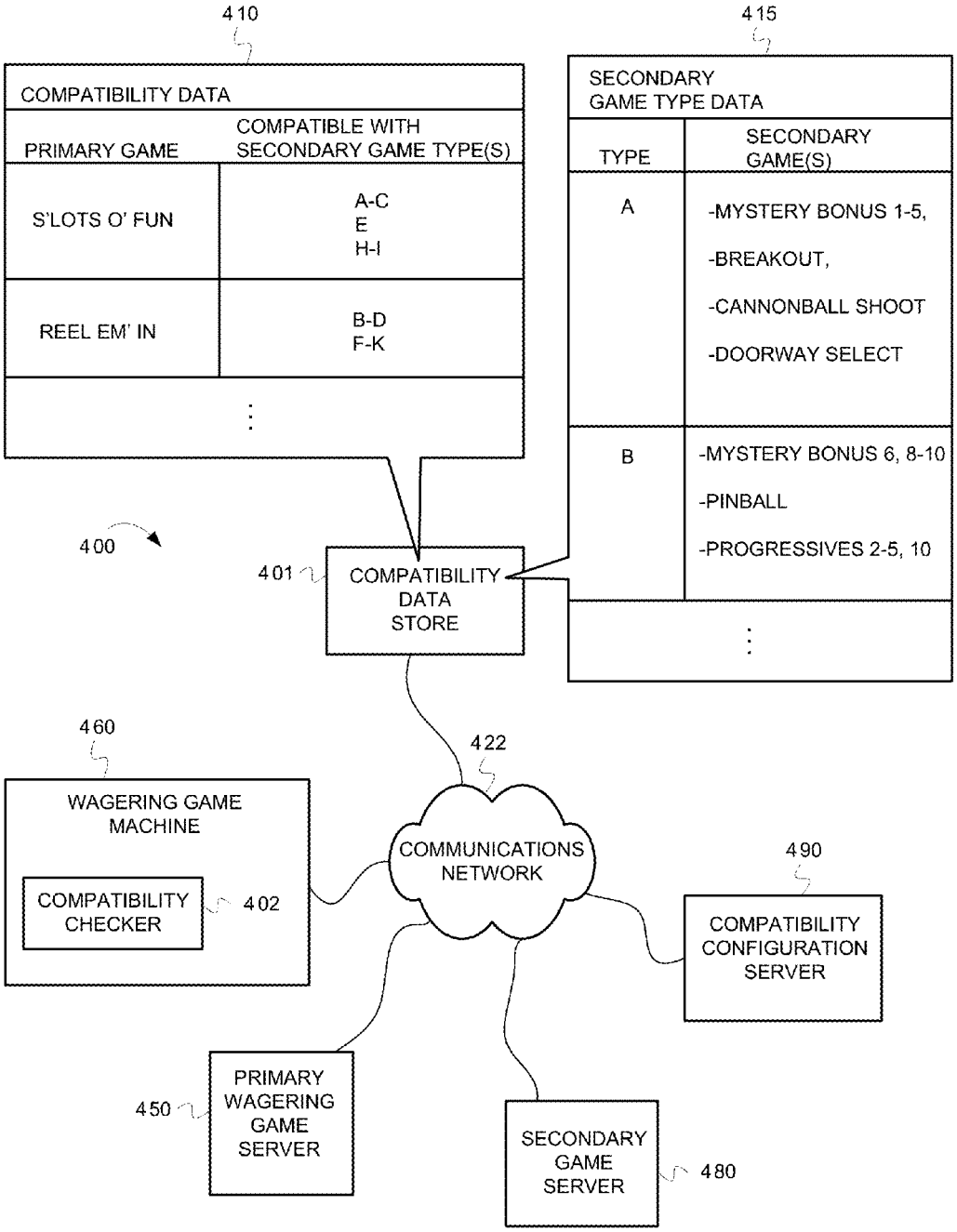
FIG. 4 is an illustration of determining compatibility between primary wagering games and secondary games using type data and compatibility data, according to some embodiments.

FIG. 3 is a flow diagram ("flow") 300 illustrating determining compatibility between primary wagering games and secondary games using type configurations, according to some embodiments. FIGS. 1 and 4 are conceptual diagrams that help illustrate the flow of FIG. 3, according to some embodiments. This description will present FIG. 3 in concert with FIGS. 1 and 4. In FIG. 3, the flow 300 begins at processing block 302, where a wagering game system ("system") presents a primary wagering game on a wagering game machine. For example, in FIG. 1, the wagering game machine 160 presents the primary wagering game 104 on the display 112. The wagering game machine 160 can present game play elements (e.g., slot reels 114), control objects (e.g., bet meter 116, spin control 118), informational displays (e.g., player tracking/promotions panel 119), etc., associated with a primary wagering game.

The flow 300 continues at processing block 304, where the system receives a request to present a secondary game in connection with the primary wagering game. In some embodiments, the system can generate and/or determine triggering events that request and/or cause the presentation of the secondary game. For example, some triggering events that can request a secondary game to occur, or that can activate (e.g., run, enable, queue, load, download, reserve, etc.) the secondary game, may include (1) a result on a primary wagering game (e.g., a slot reel combination), (2) a buy-in directly to the secondary game (e.g., buying in directly to a group game or network game), and (3) an automatic enrollment or a result of the buy-in or from the primary where the primary wagering game funds the secondary game (e.g., progressive games). In some embodiments, the system can request to present the secondary game as a plug-in to the primary game. In other embodiments, the system can request to present the secondary game separate from, but with interaction or connectivity to the primary wagering game. In some embodiments, the system can also request to utilize resources of the wagering game machine to present the secondary game (e.g., obtain use of a display, take over screen real-estate, obtain control of speakers, obtain priority use of machine hardware, etc.). The system can also determine that at least some portion of the primary wagering game (e.g., some functionality, some requirements, some data, etc.) and at least some portion of the secondary game require interaction. For example, the primary wagering game may need to communicate data to the secondary game, and vice versa, so that the primary wagering game and the secondary game can function properly (e.g., perform the interactive functional requirements, cross-communicate data, etc.). For example, in FIG. 1, the secondary game 112 may require functionality with, or access to data associated with, any one or more of the game play elements (e.g., slot reels 114), the control objects (e.g., bet meter 116, spin control 118), the informational display (e.g., player tracking/promotions panel 119), etc., associated with the primary wagering game 104. Returning to FIG. 3, another example of game interaction between primary games and secondary games is data exchange. For example, primary games and secondary games can exchange game math data ("math data"). A primary game and secondary game can utilize (e.g., share, mash up, etc.) math data for proper configuration and proper runtime operations. The following are just some examples reasons why primary and secondary games might exchange math data: an outcome of a secondary game may be a function of the outcome of a primary game, such as a multiplier; a frequency of an event in a primary game (like bonus symbol trigger frequency) may affect the outcome or frequency of a secondary game; a frequency of a feature in a secondary game may affect the outcome of a primary game, a configuration module may require the math data to mash the math data between/for the primary game and the secondary game.

The flow 300 continues at processing block 306, where the system determines a compatibility type for the secondary game. FIG. 4 illustrates an example of a wagering game system ("system") 400 that determines a compatibility type for a secondary game using pre-configured, pre-stored compatibility data. The system 400 includes a compatibility data store 401, which includes secondary game type data 415 and game compatibility data 410. The secondary game type data 415 includes unique secondary game identifiers (e.g., titles, game identification numbers, etc.) that uniquely identify specific secondary games. A secondary game server 480 can provide the secondary games, via a communications network 422, to a wagering game machine 460. The secondary game type data 415 can also include corresponding secondary game types. The types can be classified by unique identifiers (e.g., Type A, Type B, etc.), which uniquely identify a specific set of capabilities, requirements, etc. possessed (e.g., shared) in common by the secondary games that correspond to the type. The system 400 can cross-reference the requested secondary game with the secondary game type indicated in the secondary game type data 415 to determine a compatibility type for the secondary game.

The flow 300 continues at processing block 308, where the system determines whether the compatibility type for the secondary game is fully compatible with a primary wagering game API. In some embodiments, the system can determine capabilities of a primary wagering game API (e.g. determine capabilities of primary wagering game API to present features of the secondary game and/or provide information for the primary wagering game). The system can also determine capabilities for a secondary game API (e.g., to present features of the primary wagering game and/or to provide information from the secondary game). The system can also determine non-optional, or essential, requirements for the secondary game (i.e., features and/or information that the secondary game has to present without operational error, delay, missing data, disturbances, etc.). The primary wagering game API can provide access to necessary information and provide control abilities to present necessary features of the secondary game so that the secondary game can present the features and information in needs to fully function without operational error, missing information, significant delays or disturbances. The system can determine compatibility at different times and in different ways. For example, the system can determine compatibility between primary wagering games and secondary games using pre-configured data. For example, in FIG. 4, the game compatibility data 410 can indicate unique identifiers (e.g., titles, game identification numbers, etc.) that uniquely identify primary wagering games (e.g., provided by a primary wagering game server 450). The game compatibility data 410 can also include secondary game types that are compatible with the secondary games (e.g., provided by the secondary game server 480). The secondary game types indicated in the game compatibility data 410 match up to primary games that can provide a compatible link, integration, interface or other interconnectivity mechanism (e.g., compatible APIs) with the secondary game types. In other words, the compatibility data 410 indicates that a secondary game, which matches up to the secondary game type that corresponds to a primary game, can present content or other information in conjunction with the primary wagering game without experiencing operational error, missing data, or other problems. Therefore, a compatibility checker 402 can cross-reference the secondary game type data 415 with the game compatibility data 410 to determine a game type for a requested secondary game and determine whether the active primary wagering game presented on the wagering game machine 460 is compatible with the game type for the requested secondary game. In some embodiments, a compatibility configuration server 490 can pre-configure the secondary game type data 415 and the game compatibility data 410 and store the data on the compatibility data store 401. Referring back to FIG. 3, in other embodiments, however, the system can determine compatibility between primary wagering games and secondary games at game runtime, when the secondary game is requested, but before the secondary game is presented. For example, the system can automatically determine capabilities data for primary wagering games and requirements data for secondary wagering games (e.g., via capabilities metadata stored with the primary wagering games and/or requirements metadata stored with the secondary games) and cross-reference the capabilities data and requirements data with compatibility rules (e.g., stored on a compatibility configuration server, stored on the wagering game machine, or stored in other locations accessible to the system). Based on the comparison, the system can automatically determine compatibilities. It should be noted that the primary game may also need to access requirements and information from the secondary game. Therefore, in some embodiments, the system can also determine requirements for the primary wagering game, and determine whether the secondary game API capabilities will meet the non-optional, essential requirements of the primary wagering game, so that the primary wagering game can present content, information, features, etc., in conjunction with the secondary game without operational error, missing data, delays, disturbances, or other problems.

The flow 300 continues at processing block 310, where the system determines whether the compatibility type for the secondary game is partially compatible. In some embodiments, the system can determine a partial compatibility type assigned to secondary game. Sometimes, a primary wagering game may not have a feature that a secondary game uses. However, the feature that the secondary game uses is not a "requirement" per se in that the secondary game can still be compatible with the primary wagering game API except for the one or more non-required or "optional" features. Consequently, the primary wagering game API can be configured to match the secondary game API for partial compatibility, meaning that the system can assign a compatibility type that is compatible with the primary wagering game API, but with an indicator that some of the optional features are not usable. Thus, the system can assign fully compatible types with metadata indicating non-optional features that are not compatible or the system can assign different types that indicate partial compatibility. The "partial compatibility" types can be tagged, or indicated, as being subsets to fully compatible types (e.g., the partial compatibility type can be assigned as "type A:1" which indicates that it supports all of the required, or non-optional, features available within type "A", but with a "1" sub-identifier to indicate partial compatibility level "1" where certain optional features are not supported within the type A).

The flow 300 continues at processing block 312, where the system determines whether a feature can be added to make the primary wagering game and secondary game compatible. In some embodiments, to make the primary wagering game fully or partially compatible with the secondary game, the system can add a script file that may add the feature to the primary wagering game, or enable an ability of the primary wagering game's API, in some form or another, to make the primary wagering game and secondary game compatible. In some embodiments, the system may add a limited, but functional, add-on that may permit the primary wagering game to provide a function similar to that required by the secondary game. In other words, the limited add-on feature may not present content, or execute a feature exactly as the secondary game would, but the limited add-on would still present the content or execute the feature in a limited fashion (e.g., the system may add-on a limited help text present help text feature to a primary wagering game so that the primary wagering game presents help text in a tool-bar or in plain-text format instead of using animated pop-ups and graphics as the secondary game feature would). In some embodiments, the system can add features to make primary wagering games and secondary games either fully or partially compatible. In other words, the system may only be able to add functionality to the primary wagering game, or enable functionality via the primary wagering game's API, sufficient to make the primary game only partially compatible with the secondary game. In other embodiments, however, the system may be able to add functionality that would make the primary wagering game and the secondary game fully compatible.

The flow 300 continues at processing block 314, where, if the primary wagering game and secondary game are neither fully or partially compatible, the system prevents the secondary game from being presented in conjunction with the primary wagering game. The system may instead select or request another secondary game that is potentially compatible with the primary wagering game. When requesting the other secondary game, the system can repeat the flow 300 to determine compatibility. It should be noted, however, that in some embodiments, the system can still present the secondary game even if it is incompatible with the primary wagering game, but the secondary game and the primary game may not be able to communicate properly and present data in conjunction with each other.

The flow 300 continues at processing block 316, where, if the primary wagering game and secondary game are fully compatible, the system presents the secondary game to function in full compatibility mode. Full compatibility mode may include presenting the optional and non-optional features, functionality, and data of the primary wagering game and the secondary game.

The flow 300 continues at processing block 318, where, if the primary wagering game and secondary game are partially compatible, the system present the secondary game in partial compatibility mode using a portion of the secondary game features or data (e.g., using only the essential, non-optional features and/or data).

Figure 5:
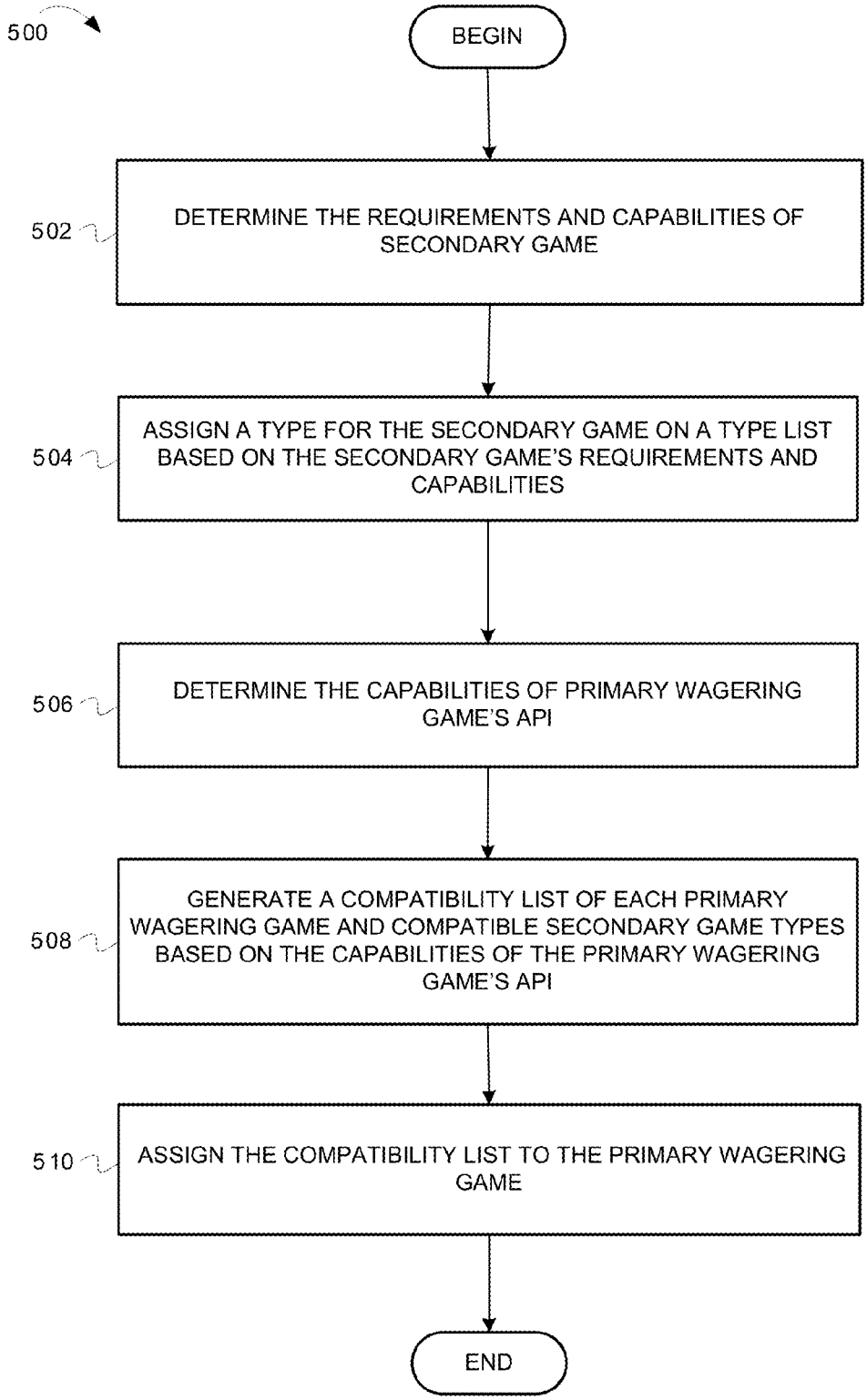
FIG. 5 is a flow diagram 500 illustrating configuring secondary games with types, according to some embodiments.
Figure 6:
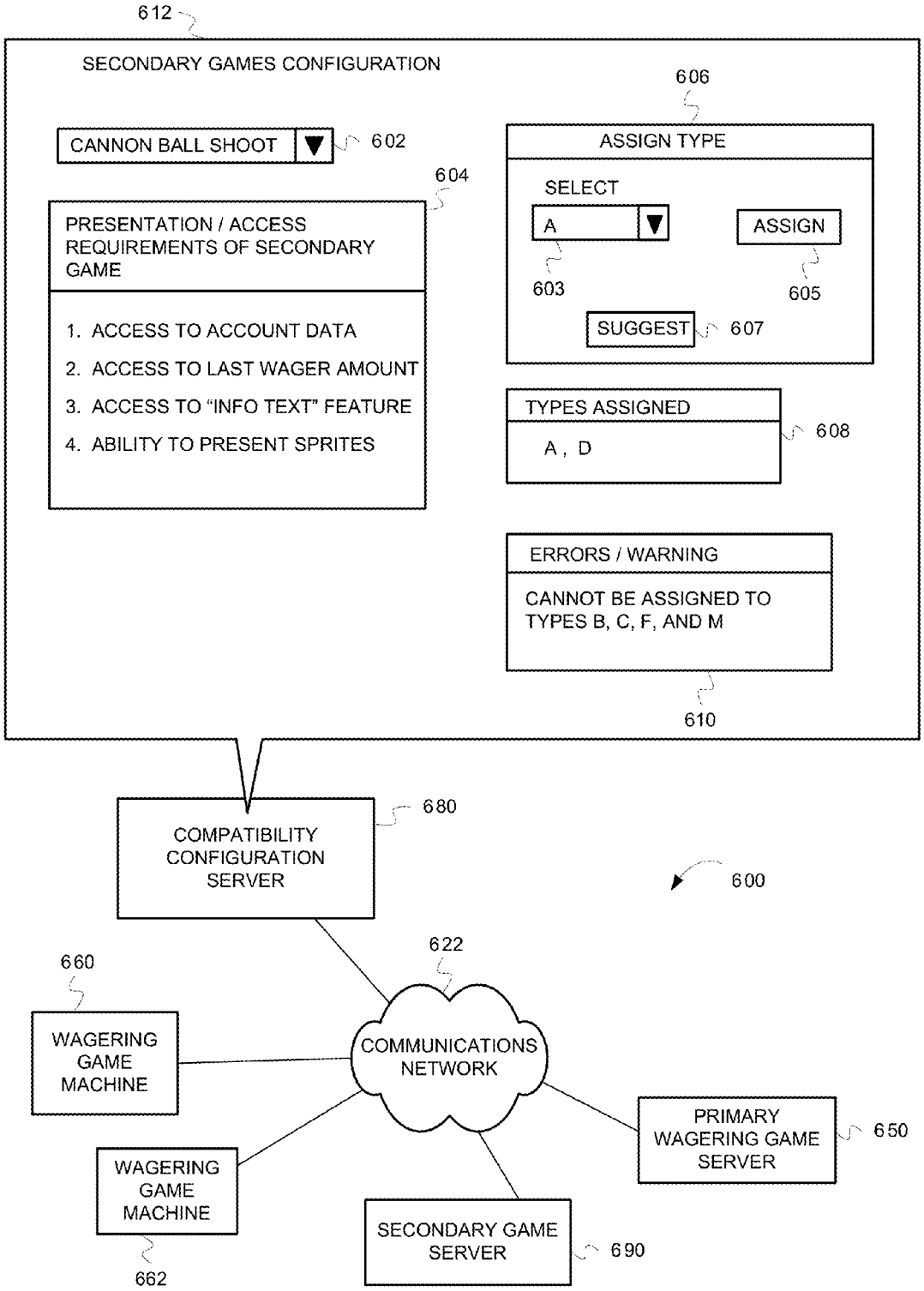
FIG. 6 is an illustration of configuring secondary games with types and storing type data on a wagering game network, according to some embodiments.

FIG. 5 is a flow diagram ("flow") 500 illustrating configuring secondary games with types, according to some embodiments. FIG. 6 is a conceptual diagram that helps illustrate the flow of FIG. 5, according to some embodiments. This description will present FIG. 5 in concert with FIG. 6, as well as with FIG. 4. In FIG. 5, the flow 500 begins at processing block 502, where a wagering game system ("system") determines requirements and capabilities of secondary game. The system can analyze the requirements and capabilities of a secondary game available from a secondary game source. The system can also determine commonalities between the requirements and capabilities of the secondary game and other secondary games available from the secondary game source. The system can generate data regarding the commonalities to create data sets that contain the groupings of common requirements and capabilities of secondary games. The system can later use those data sets to classify the secondary games into common groups, based on their common requirements and capabilities. The requirements and capabilities can be related to how the secondary game will interact with a primary wagering game. The following non-exhaustive list enumerates some example requirements and capabilities, that the system can determine, which indicate interaction or needed programming interface capabilities:

The system can determine requirements that either the primary wagering game or the secondary game behave in a certain manner to ensure compatibility. While the primary game and secondary game applications may independently execute, a well defined coordination of game play may be required for proper runtime execution. For instance, the primary game may be engineered in such a way to allow a game state where the secondary game can elegantly take over the main display. At the same time, the secondary game may be engineered to wait for the proper game state in the primary game before displaying certain game related elements. The system can perform a handshaking mechanism between the two applications, through the defined API, resulting in proper game play operation of both applications.

The system can determine requirements that a secondary game know the wager amount on the primary wagering game. For instance, the primary wagering game may have placed a bet, or wager, in a wagering game. The bet, or some other activity during the game, may trigger the secondary game that also allows the player to bet, or wager, again. However, the secondary game may want to know and/or utilize the wager that was placed in the primary game (i.e., the primary wager) so that it can use that wager amount in the secondary game for the additional wager (i.e., the secondary wager). For example, the secondary game may want to present the primary wager as a starting, or default, wager amount in the secondary game, or modify the primary wager with a modifier (e.g., a multiplier) as a bonus, or potential bonus, award in the secondary game.

The system can determine requirements that the secondary game need to contain a help or pay-table graphic page located in a certain configuration file so the primary wagering game knows where to get it for display. expected services and features from each game.

The system can determine requirements for the secondary game and primary game to present similar functionality. For example, the secondary game may utilize a graphical presentation feature as part of its functionality. The primary wagering game may also need to present the same graphical presentation feature so that the secondary game can utilize the graphical presentation feature to present specific data in common between the games (e.g., cross-over graphics that bleed from the secondary game display to the primary wagering game display, images of tokens and token data that should appear exactly the same in the primary wagering game and the secondary game, images of unique objects such as player account avatars, etc.). In some embodiments, the system can intertwine sprite functionality between the primary and secondary game. For example, the system can comprise a specialized sprite that interleaves graphical elements between a primary and secondary game. The specialized sprite may be referred to herein as a "shim" sprite. A shim sprite can originate from the primary game. For instance, the primary game can create the shim sprite as a part of its sprite tree. When the primary game runs in standalone mode (i.e., not configured with any secondary game applications) the shim sprite can have no consequential operation (e.g., it can do nothing). However, when the primary game is configured to operate with a secondary game the shim sprite can have active functionality. When a rendering engine traverses the primary games sprite tree it draws each sprite in order resulting in a Z order of the graphical elements contained in the sprite tree. When the sprite tree encounters the shim sprite, the rendering engine can relinquish control from the primary game to the secondary game. The secondary game can then draw the graphical elements it needs to draw at that specific time. Once the secondary game completes the drawing of its specific graphical elements, the primary game can regain rendering control. This results in the graphics from both primary and secondary games being properly interleaved together. An example use of a shim sprite is to have the primary game create a shim sprite in the sprite tree on top of the primary game's main background. Therefore, when the primary game is configured to run with a secondary game, the secondary game has the option to overlay graphics on top of the background, but under other primary game elements (such as the reels, meter and buttons). The secondary game has the option to completely cover the primary games main background thus resulting in a dramatically different appearance of the main game from when it runs in standalone mode. Also, the secondary game can use shim sprites to convey information about the secondary game, such as how close a game is to triggering a progressive value.

The flow 500 continues at processing block 504, where the system assigns a type for the secondary game on a type list based on the secondary game's requirements and capabilities. As mentioned previously, the system classified the secondary games into common groups, or types, based on their common requirements and capabilities. The types can, in some embodiments, indicate a type of versioning for a primary wagering game API that is needed to make the secondary game work with the primary wagering game. In some embodiments, the primary wagering game has an API element and the secondary game has an API element. The combination of the two elements that are compatible can constitute an API "type". In some embodiments, the system can store the type list on a secondary game provider, or in another location accessible to devices on a wagering game network. In some embodiments, the system can pre-configure the type list with a configuration tool. FIG. 6 illustrates an example of assigning and storing types of secondary games to a type list. In FIG. 6, a wagering game system ("system") 600 includes a compatibility configuration server 680 configured to assign types to secondary games based on requirements (e.g., presentation requirements, data access requirements, functionality requirements, etc.) of the secondary games. The compatibility configuration server 680 can present a secondary game configuration user interface ("user interface") 612 with a selection control 602 configured to select one of various secondary games. For example, in FIG. 6, the selection control 602 can select a secondary game called "cannon ball shoot", from a list of secondary games. The cannon ball shoot game may be a secondary game presented in conjunction with one or many different primary wagering games, where a player can shoot a cannon ball at targets to obtain bonus awards (e.g., extra game credits, entertainment points, free merchandise, bet multipliers for use in the primary wagering game, etc.). The compatibility configuration server 680 can access information that describes the requirements of the secondary games, for instance, by reading from sources of information that contain the presentation needs, data access needs, functionality needs, etc. The sources of information may include configuration files, database records, technical specifications, help documentation, or other sources of information related to the secondary games. The sources of information can be stored in a secondary game server 690, which may also store the secondary game content, assets, etc. The user interface 612 can also present the requirements in a requirements display 604. The compatibility configuration server 690 can determine the requirements from the information sources and list them in the requirements display 604. The compatibility configuration server 690 can organize the order of the requirements based on filter parameters, search queries, etc. The user interface 612 can also present a type assignment console 606, that an operator can use to select a specific type identifier (e.g., select type "A" from a type identifier control 603). The type assignment console 606 can also include an assignment control (e.g., assignment control button 605) that the operator can use to assign the selected secondary game (e.g., the "cannon ball shoot" game) to the type (e.g., type "A"). The type assignment console 606 can also suggest a specific type based on the requirements indicated in the requirements display 604. For example, an operator can select a suggestion control button 607 and the compatibility configuration server 690 can populate already selected types into the type identifier control 603 and exclude any other types that lack requirements, which have conflicting requirements, etc. The user interface 612 can also present an assignment indicator 608 that indicates the assigned type, or types, for the selected secondary game. The user interface 612 can also present a warning display 610 that can indicate problems with assigning types to the selected secondary game or that presents warnings about types that cannot be assigned to the selected secondary game. The compatibility configuration server 680 can create a type list of the compatibility types, similar to the secondary game type data 415 illustrated in FIG. 4. The compatibility configuration server 680 can store the type list on wagering game machines 660, 662, on the secondary game server 690, on a primary wagering game server 650, in other locations that are accessible to compatibility checking modules associated with the wagering game machines 660, 662 or in connection with other devices accessible on a communications network 622. Returning to FIG. 5, in some embodiments, the system can assign a secondary application to multiple types, if the multiple types are compatible as subsets of each other. However, in some embodiments, the system can assign a secondary application to only one type. Assigning only one type to a secondary application can simplify compatibility checking procedures between primary and secondary games so that the system can quickly and efficiently determine whether a secondary game, having only one type, is compatible with a primary wagering game, without having to consider complex compatibility subsets.

The flow 500 continues at processing block 506, where the system determines the capabilities of primary wagering game's API. In some embodiments, the system can determine capabilities of a primary wagering game's API by ascertaining details stored in documentation associated with the API (e.g., development documentation, reference documentation, etc.).

The flow 500 continues at processing block 508, where the system generates a compatibility list of each primary wagering game and compatible secondary game types based on the capabilities of the primary wagering game's API. For example, in FIG. 4, the system 400 can store the compatibility data 410 in a list (e.g., a configuration file, a database record, etc.). In some embodiments, the system can store the compatibility list with the primary wagering game provider.

The flow 500 continues at processing block 510, where the system assigns the compatibility list to the primary wagering game. The system can store the assignments into the compatibility list and associate the compatibility list with a primary wagering game. The compatibility list can indicate that the primary wagering game is compatible with certain types of secondary games. The system can look up the type list to determine whether the secondary game meets one of the types indicated as being compatible in the compatibility list. The compatibility list can be stored in a configuration file, on a wagering game machine, on a server, or other location. In some embodiments, the system can configure a wagering game machine using the information in the compatibility list. For example, when a primary wagering game is requested, an operator can determine and configure payout percentages that will be used for the primary wagering game and any secondary games that will work with the primary wagering game. The operator can refer to the compatibility list, associated with the primary wagering game, to determine which secondary games are compatible with the primary wagering game. The secondary games can indicate the types that they are associated with by querying a secondary game server, by reading configuration files associated with the secondary games of interest, by receiving parameters passed from the secondary games, etc. The operator can then match the appropriate secondary games and primary wagering games and not allow matches of incompatible types. The operator can configure the primary wagering game to run one or more secondary games at certain times or based on triggers (e.g., a progressive limit causes a trigger for secondary game to take over). Some triggers can be known (e.g., know triggers such as visible goals that will indicate to the player that the secondary game is about to be triggered, symbol triggers, etc.). Other triggers can be unknown (e.g., a mystery trigger that the player does not know about and just happens, such as a wager threshold, a random number, etc.). The operator can then enable the games for play.

Additional Example Operating Environments

This section describes example operating environments, systems and networks, and presents structural aspects of some embodiments.

Wagering Game Machine Architecture

Figure 7:
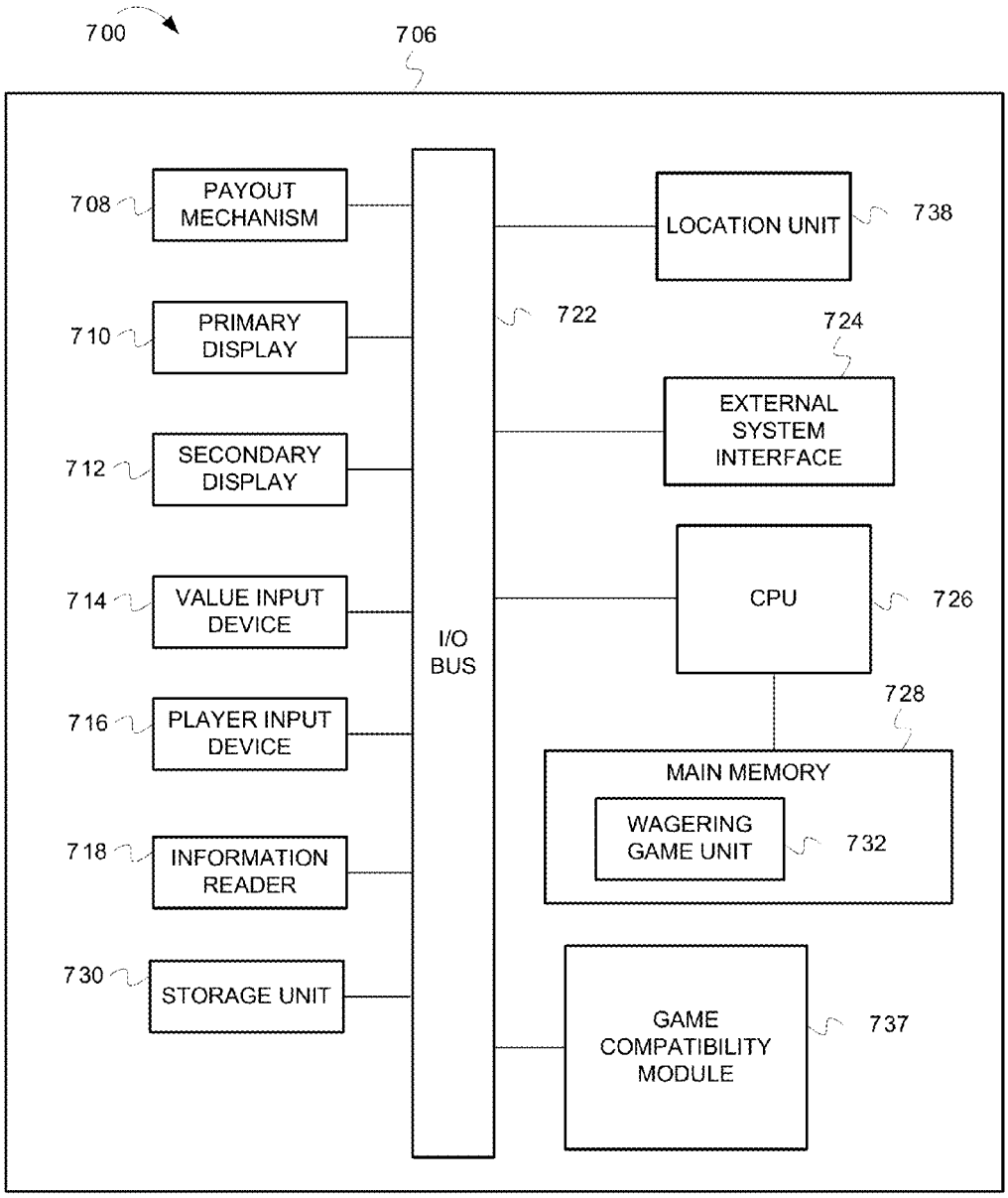
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a game compatibility module 737. The game compatibility module 737 can process communications, commands, or other information, where the processing can configure and control wagering game compatibility.

Furthermore, any component of the wagering game machine 706 can include hardware, firmware, and/or machine-readable media including instructions for performing the operations described herein.

Mobile Wagering Game Machine

Figure 8:
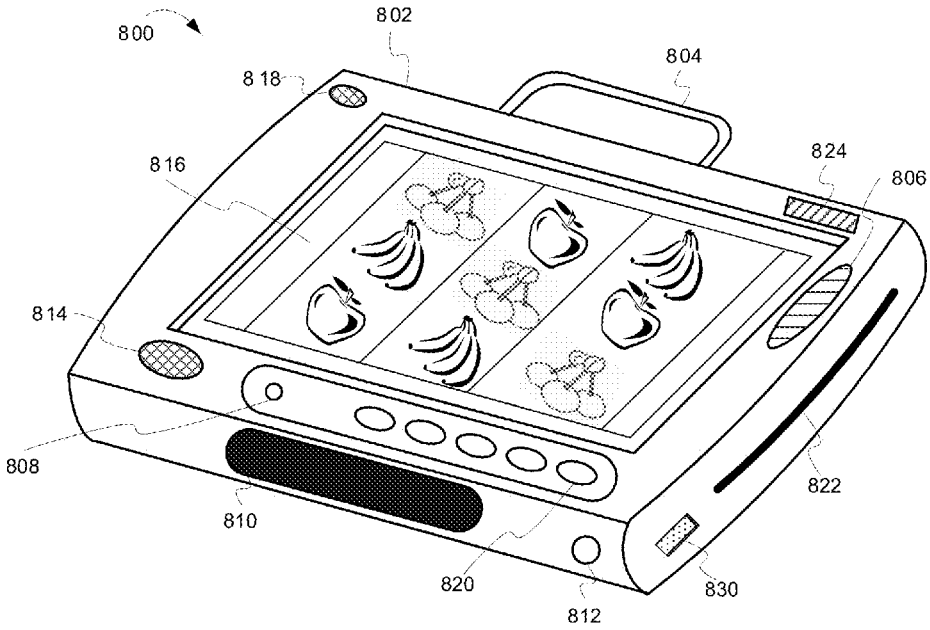
FIG. 8 is an illustration of a mobile wagering game machine 800, according to some embodiments.

FIG. 8 is a conceptual diagram that illustrates an example of a mobile wagering game machine 800, according to some embodiments. In FIG. 8, the mobile wagering game machine 800 includes a housing 802 for containing internal hardware and/or software such as that described above vis-à-vis FIG. 7. In some embodiments, the housing has a form factor similar to a tablet PC, while other embodiments have different form factors. For example, the mobile wagering game machine 800 can exhibit smaller form factors, similar to those associated with personal digital assistants. In some embodiments, a handle 804 is attached to the housing 802. Additionally, the housing can store a foldout stand 810, which can hold the mobile wagering game machine 800 upright or semi-upright on a table or other flat surface.

The mobile wagering game machine 800 includes several input/output devices. In particular, the mobile wagering game machine 800 includes buttons 820, audio jack 808, speaker 814, display 816, biometric device 806, wireless transmission devices (e.g., wireless communication units 812 and 824), microphone 818, and card reader 822. Additionally, the mobile wagering game machine can include tilt, orientation, ambient light, or other environmental sensors.

In some embodiments, the mobile wagering game machine 800 uses the biometric device 806 for authenticating players, whereas it uses the display 816 and the speaker 814 for presenting wagering game results and other information (e.g., credits, progressive jackpots, etc.). The mobile wagering game machine 800 can also present audio through the audio jack 808 or through a wireless link such as Bluetooth.

In some embodiments, the wireless communication unit 812 can include infrared wireless communications technology for receiving wagering game content while docked in a wager gaming station. The wireless communication unit 824 can include an 802.11G transceiver for connecting to and exchanging information with wireless access points. The wireless communication unit 824 can include a Bluetooth transceiver for exchanging information with other Bluetooth enabled devices.

In some embodiments, the mobile wagering game machine 800 is constructed from damage resistant materials, such as polymer plastics. Portions of the mobile wagering game machine 800 can be constructed from non-porous plastics which exhibit antimicrobial qualities. Also, the mobile wagering game machine 800 can be liquid resistant for easy cleaning and sanitization.

In some embodiments, the mobile wagering game machine 800 can also include an input/output ("I/O") port 830 for connecting directly to another device, such as to a peripheral device, a secondary mobile machine, etc. Furthermore, any component of the mobile wagering game machine 800 can include hardware, firmware, and/or machine-readable media including instructions for performing the operations described herein.

Wagering Game Machine

Figure 9:
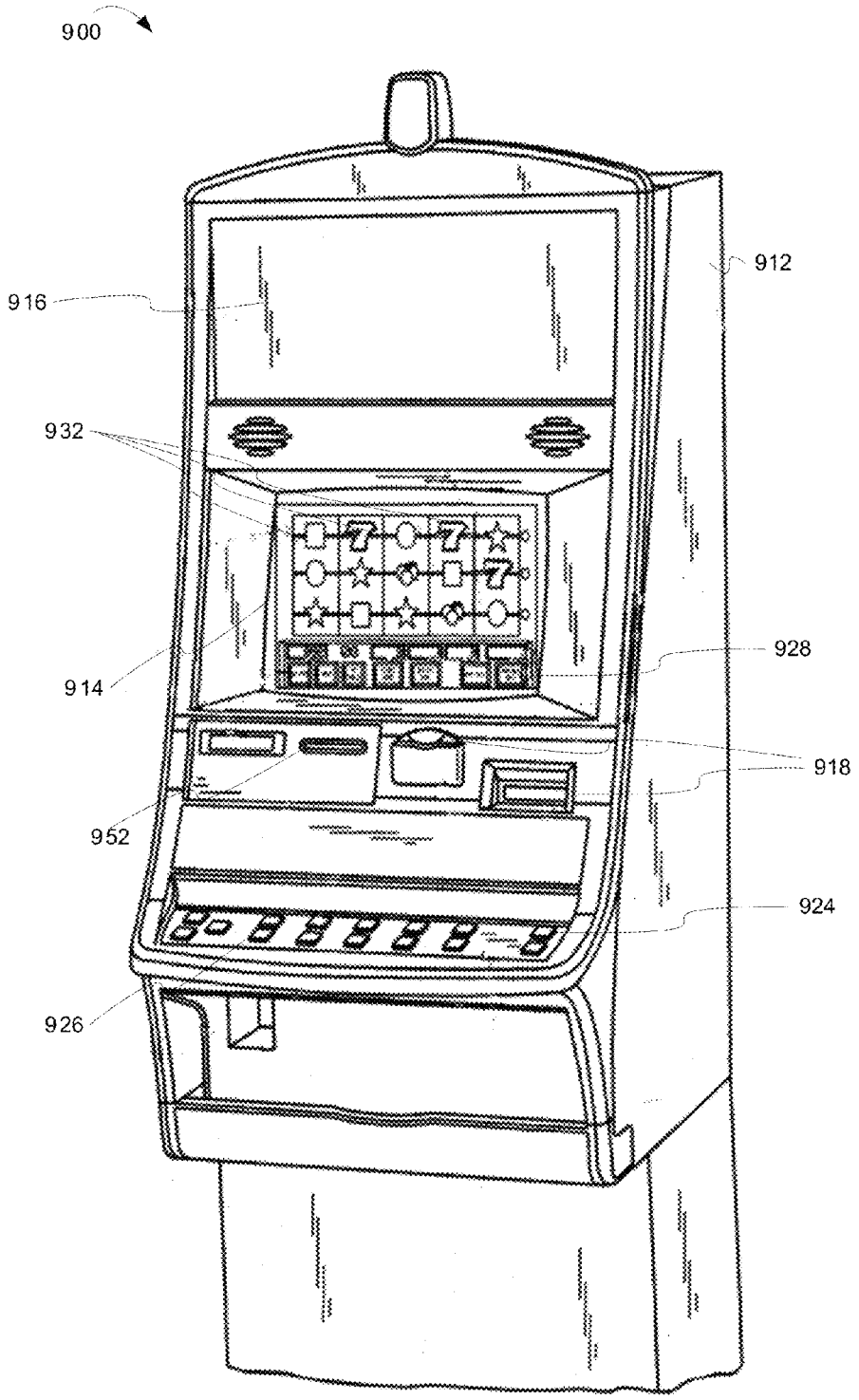
FIG. 9 is an illustration of a wagering game machine 900, according to some embodiments.

FIG. 9 is a conceptual diagram that illustrates an example of a wagering game machine 900, according to some embodiments. Referring to FIG. 9, the wagering game machine 900 can be used in gaming establishments, such as casinos. According to some embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright"

version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bar top model, mobile handheld model, or workstation console model.

A player begins playing a basic wagering game by making a wager via the value input device 918. The player can initiate play by using the player input device's buttons or touch screen 928. The basic game can include arranging a plurality of symbols along a pay line 932, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A wagering game system comprising:

one or more processors;

a primary game application configured to, with assistance of the one or more processors, present results for a primary wagering game, wherein the primary game application has a list of secondary game application types with which the primary game application is compatible;

a secondary game application configured to, with assistance of the one or more processors, present results for a secondary wagering game associated with the primary wagering game, wherein the secondary game application is of a type, and wherein the primary and secondary game applications are configured to exchange information via at least one application programming interface; and a compatibility module configured to, with assistance of the one or more processors, determine that the type of the secondary game application is on the list of secondary game application types with which the primary game application is compatible.

2. The wagering game system of claim 1, wherein the primary game application is further configured to provide information to the secondary game application via the application programming interface, wherein the information includes one or more of primary game wager information, primary game pay table information, and player help information.

3. The wagering game system of claim 1 wherein the compatibility module is further configured to determine requirements of the secondary game application and assign the type to the secondary game application.

4. The wagering game system of claim 1 wherein the compatibility module is further configured to determine capabilities of the application programming interface, and determine, based on the capabilities of the application programming interface, the list of secondary game application types with which the primary game application is compatible.

5. The wagering game system of claim 1, wherein the primary game application, the secondary game application, and the compatibility component reside in a single machine.

6. The wagering game system of claim 1, wherein the primary game application, the secondary game application, and the compatibility component reside in a plurality of machines in the wagering game system.

7. A method comprising:

determining that a secondary wagering game application is compatible with a primary wagering game application, wherein compatibility is based in-part on an ability of the primary wagering game application to provide wagering game information to the secondary wagering game application via an application programming interface, wherein the primary wagering game application is configured to provide the application programming interface, and wherein the secondary wagering game application is configured to make calls to the application programming interface to receive the wagering game information; and enabling the secondary wagering game to present a secondary wagering game in connection with a primary wagering game controlled by the primary wagering game application.

8. The method of claim 7, wherein the wagering game information includes information about wagers placed during a primary wagering game presented by the primary wagering game application.

9. The method of claim 7, wherein the compatibility is indicated by a compatibility list enumerating the secondary wagering game application as having a type compatible with the primary wagering game application.

10. The method of claim 7 further comprising:

detecting an event prompting the primary wagering game to provide wagering game information to the secondary wagering game; and providing, in response to the event, the wagering game information via the application programming interface.

11. A method comprising:

determining, via one or more processors, compatibility between a secondary wagering game application and a primary wagering game application, wherein compatibility indicates that the secondary wagering game application is capable of receiving information from the primary game application via an application programming interface;

determining, via the one or more processors, a first result for a primary wagering game, wherein the first result is for presentation by the primary wagering game application;

determining, via the one or more processors, that the secondary wagering game application has received the information via the application programming interface; and determining, via the one or more processors, a second result for a secondary wagering game, wherein the second result is for presentation by the secondary wagering game application.

12. The method of claim 11, wherein the determining compatibility between the secondary wagering game application and the primary wagering game application includes determining that the secondary game application is of a types which is compatible with a type of the primary wagering game application.

13. The method of claim 11, wherein the information indicates a wagering amount from the primary wagering game.

14. The method of claim 11, wherein the information indicates a pay table for the primary wagering game.

15. An apparatus comprising:

one or more processors;

one or more non-transitory machine readable mediums including instructions that, when executed by the one or more processors, cause the one or more processors to perform operations comprising:

providing, by a primary wagering game application, an application programming me information with a second wagering game application;

determining that the secondary wagering game application is compatible with the primary wagering game application, wherein compatibility is based in-part on the primary wagering game application being able to provide the wagering game information to the secondary wagering game application via the application programming interface, wherein the secondary wagering game application makes calls to the application programming interface to receive the wagering game information from the primary wagering game application;

means for enabling the secondary wagering game to present a secondary wagering game in connection with a primary wagering game controlled by the primary wagering game application.

16. The apparatus of claim 15, wherein the wagering game information includes information about wagers placed during a primary wagering game presented by the primary wagering game application.

17. The apparatus of claim 15, wherein the compatibility is indicated by a compatibility list enumerating the secondary wagering game application as having a type compatible with the primary wagering game application.

18. The apparatus of claim 15, where the operations further comprise:

detecting an event prompting the primary wagering game to provide wagering game information to the secondary wagering game; and providing, by the in response to the event, the wagering game information via the application programming interface.

* * * * *